United States Patent [19]

Hinata et al.

[11] 4,046,572

[45] Sept. 6, 1977

[54] SILVER HALIDE PHOTOGRAPHIC LIGHT SENSITIVE MATERIAL

[75] Inventors: Masanao Hinata; Yuji Mihara; Akira Sato; Tadashi Ikeda, all of Minami-ashigara, Japan

[73] Assignee: Fuji Photo Film Co., Ltd., Minami-ashigara, Japan

[21] Appl. No.: 701,271

[22] Filed: June 30, 1976

[30] Foreign Application Priority Data

June 30, 1975 Japan ..... 50-81182

[51] Int. Cl.[2] ..... G03C 1/76; G03C 1/20

[52] U.S. Cl. ..... 96/69; 96/74; 96/100 R; 96/126; 96/133

[58] Field of Search ..... 96/126, 133, 69, 74, 96/100

[56] References Cited

U.S. PATENT DOCUMENTS

| | | | |
|---|---|---|---|
| 2,481,464 | 9/1949 | Anish | 96/133 |
| 3,615,613 | 10/1971 | Shiba et al. | 96/126 |
| 3,635,721 | 1/1972 | Sato et al. | 96/126 |

*Primary Examiner*—J. Travis Brown

*Attorney, Agent, or Firm*—Sughrue, Rothwell, Mion, Linn and Macpeak

[57] ABSTRACT

An improved silver halide photographic light-sensitive material comprising a support having coated thereon at least one photographic emulsion layer containing a dicarbocyanine dye having two heterocyclic nuclei which are 5- or 6-membered nitrogen-containing nuclei and which are connected to each other at the carbon atom in the 2- or 4-position thereof through a pentamethine chain, which can be substituted in the meso-position, a nitrogen atom of one nitrogen-containing heterocyclic nucleus of said carbocyanine dye being substituted by a sulfo- or carboxy-containing alkyl group, and a nitrogen atom of the other nitrogen-containing heterocyclic nucleus being substituted by an aralkyl group or an aryloxyalkyl group, with the proviso that said aralkyl and aryloxyalkyl groups are not substituted by a sulfo group or a carboxyl group.

28 Claims, No Drawings

SILVER HALIDE PHOTOGRAPHIC LIGHT SENSITIVE MATERIAL

BACKGROUND OF THE INVENTION

1. Field of the Invention

The present invention relates to a silver halide photographic light-sensitive material which contains a silver halide emulsion layer having an improved spectral sensitizing action, and, more particularly, it is concerned with a silver halide photographic light-sensitive material (wherein certain couplers may be incorporated or not) made up of at least two silver halide emulsion layers including a red-sensitive silver halide emulsion layer. Another layer may be another red-sensitive silver halide emulsion layer, a blue-sensitive silver halide emulsion layer or a green-sensitive silver halide emulsion layer.

2. Description of the Prior Art

It is well known in the art of sensitive material making that a silver halide photographic light-sensitive material, especially a color sensitive material, has a multilayer structure comprising at least one red-sensitive emulsion layer, at least another photosensitive emulsion layer, an interlayer and other layers. In such a case, spectral sensitization techniques (i.e., techniques of enlarging the wavelength region of radiation sensitivity which a silver halide photographic emulsion inherently possesses, by adding certain sensitizing dyes thereto) have been commonly applied in order to provide blue sensitivity, green sensitivity and red sensitivity to the respect photosensitive emulsion layers.

The spectral sensitizing powder depends upon the chemical structure of a spectral sensitizing dye itself and the nature of the emulsion wherein said dye is incorporated (e.g., the composition of halogens constituting the silver halide grains incorporated therein, the crystal habit thereof, the silver ion concentration, the hydrogen ion concentration and so on). In addition, the spectral sensitivity achievable by taking advantage of spectral sensitization techniques can also be influenced by additives as are universally employed in the photographic art, such as a stabilizer, an anti-foggant, a coating assistant, a color coupler and so on, which are present in the emulsion to which a sensitizing dye is added. Examples of conventionally used sensitizing dyes which can provide red sensitivity to the emulsion layer containing them include, for example, quinoline nucleus-containing carbocyanine dyes as are disclosed in U.S. Pat. No. 3,556,800; rhodacyanine dyes as are disclosed in Japanese Patent Publication 4,930/68; merocyanine dyes as are disclosed in U.S. Pat. No. 3,416,927; dicarbocyanine dyes as are disclosed in U.S. Pat. Nos. 2,503,776 and 3,635,721, Japanese Patent Publication 550/71 and Hamer, *The Cyanine Dyes and Related Compounds*, p. 207 (1964), published by Interscience Publication; and so on.

However, the fact that the addition of these sensitizing dyes to a silver halide emulsion produces side effects undesirable from a photographic point of view is also well known. The most undesirable of the above described side effects in the production of multilayer silver halide color photographic materials of high spectral sensitivity are a deterioration phenomenon which increases with the passage of time (spectral sensitivity tends to deteriorate with the passage of time) and a diffusion sensitization action (the phenomenon that some portion of the sensitizing dye added to a certain emulsion layer diffuses into other layers with the passage of time without remaining where it was added, and exert an undesirable sensitization effect in the final layer into which they diffuse; such a phenomenon is termed "diffusion sensitization" hereinafter).

In particular, diffusion sensitization has a very bad effect on photographic properties because sensitizing dyes added to a red-sensitive emulsion layer diffuse into a green-sensitive and/or a blue-sensitive emulsion layer to result in panchromatic sensitization, which is responsible for color mixing (muddiness) in developed color images, for the decreased green sensitivity of the green-sensitive layer and/or the decreased blue sensitivity of the blue-sensitive layer.

Therefore, research and development of sensitizing dyes which cause little diffusion sensitization have been an important subject in this art.

Dicarbocyanine sensitizing dyes (containing a pentamethine chain therein) are, in general, superior to conventional sensitizing dyes employed for providing red sensitivity to a silver halide emulsion such as a 4-quinoline nucleus-containing carbocyanine dye (having a trimethine chain), a tetramethinemerocyanine dye and a rhodacyanine dye at various points, for example, from the viewpoint of keeping spectral sensitivity in a sensitive material, of keeping sensitivity upon dissolution in the emulsion before it is coated, solubility, sensitizing properties, printing aptitude and temperature dependence, but they have the difficulties that their spectral sensitivity is substantially reduced with the passage of time and they result in an appreciable diffusion sensitization under conditions of high humidity.

Accordingly, it is actually difficult to use commonly known dicarbocyanine dyes as they are (independently) without overcoming the above described difficulties. However, it has been believed that dyes of this kind would be very useful dyes capable of providing red sensitivity to a silver halide photographic emulsion if the above described difficulties could be overcome.

SUMMARY OF THE INVENTION

Therefore, one object of the present invention is to provide a red-sensitive silver halide photographic emulsion wherein diffusion sensitization is prevented from occurring.

Another object of the present invention is to provide a red-sensitive silver halide photographic emulsion wherein spectral sensitivity deteriorates only slightly with the passage of time.

A further object of the present invention is to provide a silver halide photographic emulsion which is rendered highly red-sensitive upon spectral sensitization.

The above described objects are attained with a silver halide photographic emulsion containing a dicarbocyanine sensitizing dye of the kind which has one nitrogen-containing heterocyclic nucleus substituted by a sulfo-containing alkyl or a carboxy-containing alkyl group at the nitrogen position thereof and the other nitrogen-containing heterocyclic nucleus substituted by an aralkyl or an aryloxyalkyl group (excluding such groups which are sulfo- or carboxy substituted) at the nitrogen position thereof. Of these dicarbocyanine dyes, meso substituted dyes gave the best results from the standpoint of high sensitivity.

Thus, the independent use of a dicarbocyanine dye of the kind which contains two particularly selected substituents as described above where the two nitrogen-containing heterocyclic rings thereof are substituted at individual nitrogen positions prevents spectral sensitivity from deteriorating with the passage of time and diffusion sensitization from occurring, even under conditions of high humidity. Such is particularly surprising in view of the fact that deterioration of spectral sensitivity and diffusion sensitization are remarkably promoted on keeping silver halide photographic light-sensitive materials under conditions of high humidity in a conventional manner. In addition, another advantage of the dicarbocyanine dyes which are employed in the present invention is that they result in little stain after development treatments.

DETAILED DESCRIPTION OF THE INVENTION

The pentamethine chain of a dicarbocyanine dye employed in the practice of the present invention can have a substituent, if desired. For example, the pentamethine chain may be substituted by a group at the $\beta$-position or the $\alpha$-position, as is disclosed in U.S. Pat. Nos. 3,431,110, and 3,458,318 and the like.

Further, the dicarbocyanine dyes of this invention include those in which methine groups are attached to the $\beta$- and $\beta'$-position of the pentamethine chain thereof and are fused to form a 6-membered ring as disclosed in U.S. Pat. No. 3,615,632.

Throughout the following disclosure, unless otherwise indicated, any alkyl group or alkyl moiety has 1 to 4 carbon atoms, and any aryl group or aryl moiety has 6 to 12 carbon atoms.

In addition, dicarbocyanine dyes represented by the following general formula (I) can be used to advantage in the present invention:

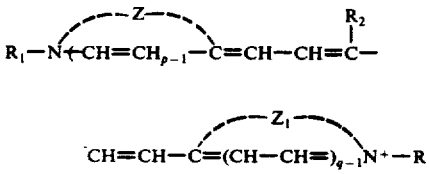

$(X^-)_{n-1}$ (I)

where R represents a sulfo group-containing alkyl group (preferably containing an alkyl moiety having from 1 to 4 carbon atoms), such as a sulfoalkyl group (e.g., a 2-sulfoethyl group, 3-sulfopropyl group, 3-sulfobutyl group, 4-sulfobutyl group and the like), hydroxy-, acetoxy- or alkoxy (whose alkyl moiety preferably has 1 to 4 carbon atoms)-substituted sulfoalkyl groups (e.g., a 2-hydroxy-3-sulfopropyl group, 2-(3-sulfopropoxy)ethyl group, 2-acetoxy-3-sulfopropyl group, 3-methoxy-2-(3-sulfopropoxy)propyl group 2[2-(3-sulfopropoxy)ethoxy]ethyl group, 2-hydroxy-3-(3'-sulfopropoxy)propyl group and the like), a sulfoaralkyl group (e.g., a p-sulfophenethyl group, p-sulfobenzyl group and the like) and so on, or a carboxyl group-containing alkyl group (which preferably contains an alkyl moiety having from 1 to 4 carbon atoms) such as a carboxymethyl group, 2-carboxyethyl group, 3-carboxypropyl group, 2-(2-carboxyethoxy)ethyl group, p-carboxybenzyl group or the like; $R_1$ represents an aralkyl group such as a benzyl group, a phenethyl group, a phenylpropyl group, a phenylbutyl group, an alkyl-substituted aralkyl group (e.g., p-methylphenethyl, p-tolylpropyl, etc.), an alkoxy-substituted aralkyl group (e.g., p-methoxyphenethyl, etc.), a halogen-substituted aralkyl group (e.g., p-chlorophenethyl, m-chlorophenethyl, etc.) and so on, or an aryloxyalkyl group such as a phenoxyethyl group, a phenoxypropyl group, a phenoxybutyl group, an alkyl- or alkoxy-substituted aryloxyalkyl group (e.g., p-methylphenoxyethyl, p-methoxyphenoxypropyl, etc.), wherein sulfo- or carboxy-substituted aralkyl and aryloxy groups are excluded; $R_2$ represents a hydrogen atom, a halogen atom such as a fluorine atom, a chlorine atom, a bromine atom or the like, an alkyl group such as a methyl group, an ethyl group, a propyl group or the like, or an aralkyl group such as a benzyl group, a phenethyl group or the like, of which an alkyl group or an aralkyl group are preferred; $p$ and $q$ represent 1 or 2; $n$ represents 1 or 2 (when $n$ equals 1, the dye forms an intramolecular salt); X represents an anion; and Z and $Z_1$ each represents the nonmetallic atoms necessary to form a 5- or 6-membered nitrogen-containing hetereocyclic nucleus. Examples of the heterocyclic nuclei include thiazole nuclei (e.g., thiazole, 4-methylthiazole, 4-phenylbenzothiazole, 4,5-dimethylthiazole, 4,5-diphenylthiazole, benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 5-bromobenzothiazole, 5-iodobenzothiazole, 5-phenylbenzothiazole, 5-methoxybenzothiazole, 6-methoxybenzothiazole, 5-ethoxybenzothiazole, 5-carboxybenzothiazole, 5-ethoxycarbonylbenzothiazole, 5-phenethylbenzothiazole, 5-fluorobenzothiazole, 5-trifluoromethylbenzothiazole, 5,6-dimethylbenzothiazole, 5-hydroxy-6-methylbenzothiazole, tetrahydrobenzothiazole, 4-phenylbenzothiazole, naphtho[2,1-d]-thiazole, naphtho[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, 5-methoxynaphtho[2,3-d]thiazole, etc.), selenazole nuclei (e.g., 4-methylselenazole, 4-phenylselenazole, benzoselenazole, 5-chlorobenzoselenazole, 5-methoxybenzoselenazole, 5-methylbenzoselenazole, 5-hydroxybenzoselenazole, naphtho[2,1-d]selenazole, naphtho[1,2-d]selenazole, etc.), oxazole nuclei (e.g., oxazole, 4-methyloxazole, 4-ethyloxazole, 5-methyloxazole, 4-phenyloxazole, 4,5-diphenyloxazole, benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-trifluorobenzoxazole, 5-hydroxybenzoxazole, 5-carboxybenzoaxazole, 6-methylbenzoxazole, 6-chlorobenzoxazole, 6-methoxybenzoxazole, 6-hydroxybenzoxazole, 5,6-dimethylbenzoxazole, 4,6-dimethylbenzoxazole, 5-ethoxybenzoxazole, naphtho[2,1-d]oxazole, naphtho-[1,2-d]oxazole, naphtho[2,3-d]oxazole, etc.), quinoline nuclei (e.g., 2-quinoline, 3-methyl-2-quinoline, 5-ethyl-2-quinoline, 6-methyl-2-quinoline, 8-fluoro-2-quinoline, 6-methoxy-2-quinoline, 6-hydroxy-2-quinoline, 8-chloro-2-quinoline, 8-fluoro-4-quinoline, etc.), 3,3-dialkylindolenine nuclei (e.g., 3,3-dimethylindolenine, 3,3-diethylindolenine, 3,3-dimethyl-5-cyanoindolenine, 3,3-dimethyl-5-methoxyindolenine, 3,3-dimethyl-5-methylindolenine, 3,3-dimethyl-5-chloroindolenine, etc.), imidazole nuclei (e.g., 1-methylimidazole, 1-ethylimidazole, 1-methyl-4-phenylimidazole, 1-phenylimidazole, 1-ethyl-4-phenylimidazole, 1-methylbenzimidazole, 1-ethylbenzimidazole, 1-methyl-5-chlorobenzimidazole, 1-ethyl-5-chlorobenzimidazole, 1-methyl-5,6-dichlorobenzimidazole, 1-ethyl-5,6-dichlorobenzimidazole, 1-alkyl-5-methoxybenzimidazole, 1-methyl-5-cyanobenzimidazole, 1-ethyl-5-cyanobenzimidazole, 1-methyl-5-fluorobenzimidazole, 1-ethyl-5-fluorobenzimidazole, 1-phenyl-5,6-dichlorobenzimidazole, 1-allyl-5,6-dichlorobenzimidazole, 1-allyl-5-chlorobenzimidazole, 1-phenylbenzimidazole, 1-phenyl-5-chlorobenzimidazole, 1-methyl-5-trifluoromethylbenzimidazole, 1-ethyl-5-trifluoromethylbenzimidazole, 1-ethylnaphtho-[1,2-d]imidazole, etc.), pyridine nuclei (e.g., pyridine, 5-methyl-2-pyridine, 3-methyl-4-pyridine, etc.), and so on. Preferably, thiazole nuclei and oxazole nuclei are advantageous for use herein. More preferably, benzothiazole nuclei, naphthothiazole nuclei and naphthoxazole nuclei are advantageous for use herein.

Specific examples of the synthesis of spectral sensitizing dyes which can be employed in the practice of the present invention are illustrated below. However, the present invention is not intended to be construed as limited to these examples. Unless otherwise indicated, all the following synthesis examples were at atmospheric pressure. [I] synthesis of anhydro-2-{3-methyl-5-[6-methyl-3-(2-phenethyl)2-benzothiazolinylidene]-1,3-pentadienyl}-6-methyl-3-(4-sulfobutyl)benzothiazolium hydroxide Dye (a)

1.0 g of anhydro-2-(4-ethoxy-3-methyl-1,3-butadienyl)6-methyl-3-(4-sulfobutyl)benzothiazolium hydroxide and 0.88 g of 2,6-dimethyl-3-β-phenethylbenzothiazolium bromide were added to 200 ml of ethanol, and, further, 3 ml of triethylamine was dropped into the ethanol solution while heating at 40° - 78° C. The mixture was then refluxed by heating for 60 minutes, whereafter the reaction product was crystallized. The resulting precipitate was filtered off. The crude crystals were recrystallized from a mixed solvent consisting of methanol and ethanol, whereby 320 mg of dye was obtained. m.p. = 255° C, $\lambda_{max}^{MeOH}$ = 661 nm, Analytical Calculated (hereafter Anal. Calcd.): C: 66.22 H: 5.88 N: 4.54 Found: C: 66.01 H: 5.86 N: 4.53.

[II] Synthesis of anhydro-2-{3-methyl-5-[5,6-dimethyl-3-(2-phenethyl)-2-benzothiazolinylidene]-1,3-pentadienyl}-6-methyl-3-(4-sulfobutyl)benzothiazolinium hydroxide Dye (b)

3.00 g of anhydro-2-(4-ethoxy-3-methyl-1,3-butadienyl)-6-methyl-3-(4-sulfobutyl)benzothiazolium hydroxide and 2.75 g of 2,5,6-trimethyl-3-β-phenethylbenzothiazolium bromide were dissolved into 200 ml of ethanol, and, further, 4 ml of triethylamine was dropped thereinto. The mixture was refluxed while heating for 100 minutes. The solvent was crystallized, whereby a dye separated out as crystals on cooling. The crystals were filtered off and washed with ethanol. 4.3 g of crude crystals of the dye were obtained which were recrystallized from a mixed solvent consisting of methanol and ethanol (methanol: ethanol = 1:5 by vvolume; hereafter the same unless otherwise indicated), whereby 3.16 g of dye was obtained. m.p. = 213° C, $\lambda_{max}^{MeOH}$ = 663 nm, Anal. Calcd.: C: 66.65 H: 6.07 N: 4.44 Found: C: 66.39 H: 6.08 N: 4.44. [III] Synthesis of anhydro-2-3-benzyl-5-[5,6-dimethyl-3-(3-phenoxypropyl)2-benzothiazolinylidene]-1,3-pentadienyl-5,6-dimethyl-3-(3-sulfopropyl)benzothiazolinium hydroxide Dye (c)

2.00 g of anhydro-2-(3-benzyl-4-ethoxy-1,3-butadienyl)-5,6-dimethyl-3-(3-sulfopropyl)benzothiazolium hydroxide and 1.62 g of 2,5,6-trimethyl-3-(3-phenoxypropyl)benzothiazolium bromide were dissolved into 200 ml of ethanol, and, further, 4 ml of triethylamine was added thereto. After the mixture was refluxed while heating for 60 minutes, it was cooled. The resulting precipitate of a dye was filtered off. 2.7 g of crude dye was thus obtained, which was recrystallized from a mixed solvent consisting of methanol and ethanol, whereby 2.38 g of dye was obtained. m.p. = 242° C, $\lambda_{max}^{MeOH}$ = 661 nm, Anal. Calcd.: C: 68.46 H: 6.02 N:3.80 Found C: 68.31 H: 6.09 N: 3.78. [IV] Synthesis of 2-{3-methyl-5-[5,6-dimethyl-3-(2-phenethyl)-2-benzothiazolinylidene]-1,3-pentadienyl}-3-(2-carboxyethyl)-6-methylbenzothiazolium bromide Dye (d)

2.00 g of 3-(2-carboxyethyl)-2-(4-ethoxy-3-methyl-1,3-butadienyl)-6-methylbenzothiazolium bromide and 1.75 g of 2,5,6-trimethyl-3-β-phenethylbenzothiazolium bromide were dissolved in 200 ml of ethanol, and, further, 3.5 ml of triethylamine was added thereto. The mixture was refluxed while heating for 30 minutes and then crystallized. Isopropanol and acetone were added to the residue, separating out a precipitate of the dye which was filtered off and washed with acetone, whereby 2.33 g of crude dye was obtained. The product was dissolved into a mixed solvent containing methanol and chloroform in a ratio of 3:2 (volume) and recrystallized from ethanol. 1.45 g of dye was obtained. m.p. = 208° C, $\lambda_{max}^{MeOH}$ = 663 nm, Anal. Calcd.: C: 63.04 H: 5.45 N: 4.33 Found: C: 62.87 H: 5.46 N: 4.32. [V] Synthesis of anhydro-2-{3-ethyl-5-[3-(2-phenoxyethyl)-2-benzothiazolinylidene]-1,3-pentadienyl}-5,6-dimethyl-3-(3-sulfobutyl)benzothiazolium hydroxide Dye (e)

3.0 g of anhydro-2-(4-ethoxy-3-ethyl-1,3-butadienyl)-5,6-dimethyl-3-(3-sulfobutyl)benzothiazolium hydroxide and 3.5 g of 2-methyl-3-(2-phenoxyethyl)-2-benzothiazolium p-toluene sulfonate were dissolved in 30 ml of ethanol, and, further, 4 ml of triethylamine was added thereto. The mixture was refluxed while heating for 30 minutes. Next, the reaction mixture was cooled in an ice bath. The resulting precipitate was filtered off, washed with acetone and recrystallized from a methanolethanol mixed solvent, whereby 3.3 g of dye was obtained. m.p. = 258° C, $\lambda_{max}^{MeOH}$ = 661 nm, Anal. Calcd.: C: 65.00 H: 5.92 N: 4.33 Found: C: 64.86 H: 5.91 N: 4.29.

Other dyes which can be employed in the practice of the present invention can be prepared in a similar manner to the above described examples. Namely, the dyes can be easily prepared from a compound represented by the following general formula (II):

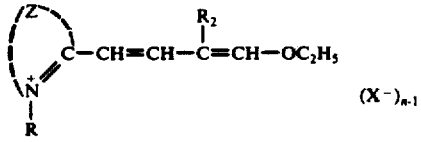

(II)

(wherein R, $R_2$, Z, X and $n$ each has the same meaning as in Formula (I) described above) and a compound represented by the following general formula (III):

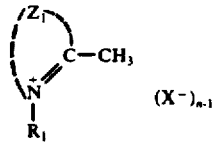

(III)

(wherein $R_1$ and $Z_1$ each has the same meaning as in Formula (I) described above, $n$ represents 1 or 2 and where $n$ equals 1 the compound forms an intramolecular salt, and X represents an acidic residue or counter anion such as a chlorine atom, a bromine atom, an iodine atom, benzene sulfonate, p-toluene sulfonate, methyl sulfonate or the like) by reacting them in the presence of an alkaline condensing agent (e.g., triethyl amine, pyridine, morpholine, sodium acetate, sodium ethylate, etc.) in an inactive solvent (e.g., ethanol, methanol, isopropanol, acetonitrile, dimethylformamide, dimethyl sulfoxide, nitrobenzene, dimethyl acetoamide, γ-butyrolactum, water, m-cresol, methyl cellosolve, etc.) while heating to an appropriate temperature within the range of 0° C to the boiling point of the solvent used (preferably, from 50° C to 150° C). Moreover, the dyes can also be prepared with ease by reference to U.S. Pat. No. 3,635,721 by one skilled in the art.

Specific examples of the dyes effectively employed in the present invention include the following dyes.

Dye (a)

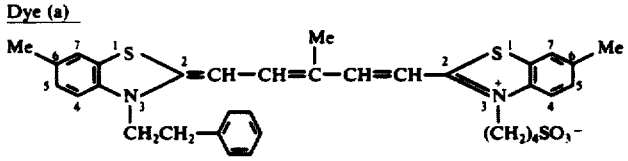

Dye (b)

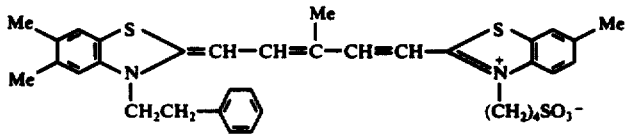

Dye (c)

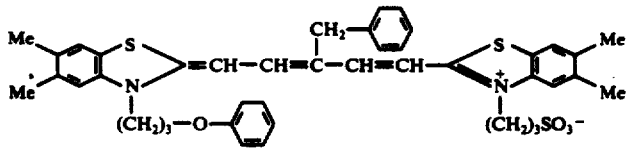

Dye (d)

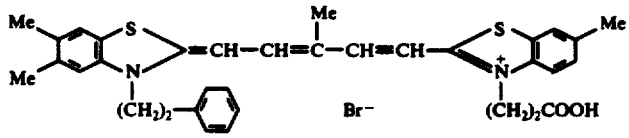

Dye (e)

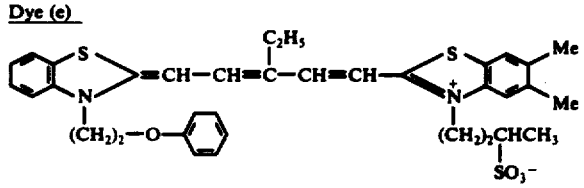

Dye (f)

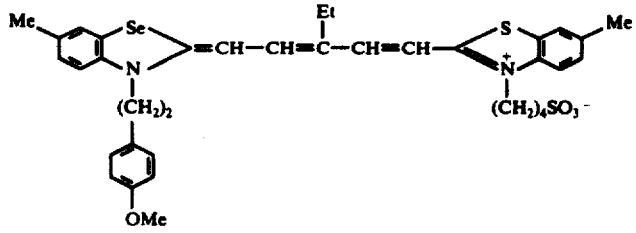

Dye (g)

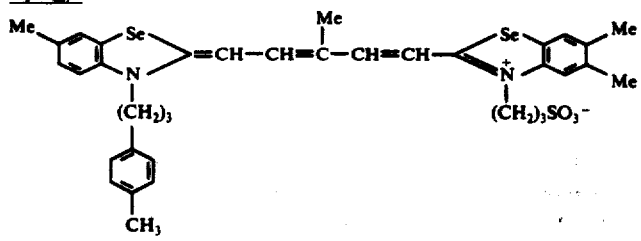

Dye (h)

-continued

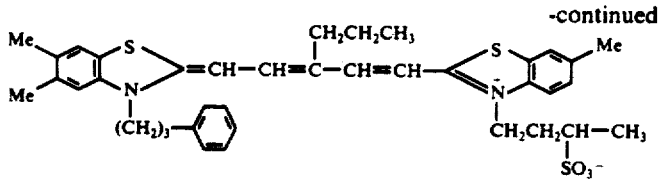

Dye (i)

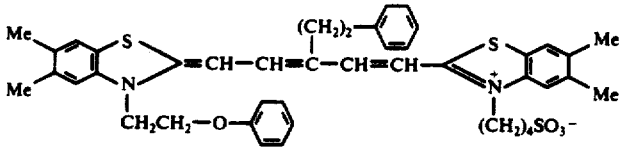

Dye (j)

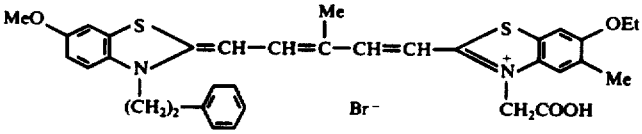

Dye (k)

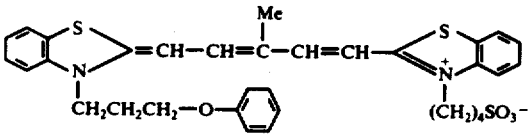

Dye (l)

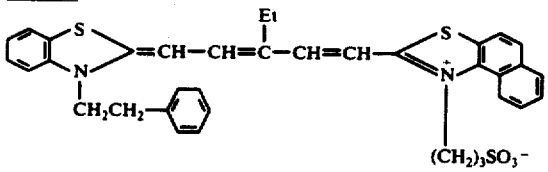

Dye (m)

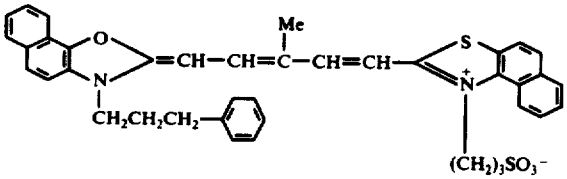

Dye (n)

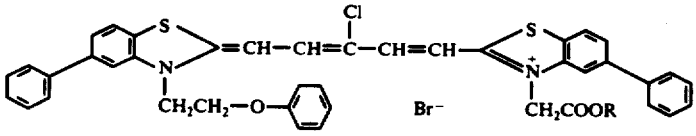

Dye (o)

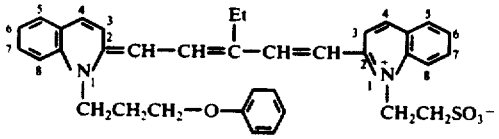

(wherein Me represents a methyl group, and Et represents an ethyl group).

Examples of $R_1$ in general formula (I) representing the dicarbocyanine dyes more favorably employed in the practice of the present invention include a phenethyl group, a phenylpropyl group, a phenylbutyl group, a phenoxyethyl group, a phenoxypropyl group and a phenoxybutyl group.

Each dicarbocyanine dye which can be employed in the practice of the present invention is incorporated into a silver halide emulsion to advantage in an amount ranging from about $1 \times 10^{-5}$mol to about $2 \times 10^{-3}$mol per mol of silver. When more than one dye within the above formula is utilized, the total amount of dyes advantageously falls within the recited range.

The dicarbocyanine dyes used in the practice of the present invention can be directly dispersed into an emulsion. On the other hand, the dyes can also be added to a silver halide emulsion as a solution prepared by dissolving the dyes in an appropriate solvent, for example, methyl alcohol, ethyl alcohol, methyl cellosolve, acetone, water, pyridine or mixed solvents thereof. Moreover, the dicarbocyanine dyes can be dissolved using ultrasonic vibration. In addition, the dicarbocyanine dyes may also be added to a silver halide emulsion according to the following various methods: the dye is dissolved into a volatile organic solvent, the solution is dispersed into a hydrophilic colloid and then the resulting dispersion is added to an emulsion, as disclosed in U.S. Pat. No. 3,469,987; a water insoluble dye is dispersed into a water soluble solvent without dissolving it, and then the resulting dispersion is added to an emulsion, as disclosed in Japanese Patent Publication 24,185/71; the dye is dissolved in a surface active agent and then the solution is added to an emulsion, as disclosed in U.S. Pat. No. 3,822,135; and the dye is dissolved using a red-shift compound, and then the solution is added to an emulsion, as disclosed in Japanese Patent Application 946/75. Besides the above methods, applicable methods for adding the dyes to an emulsion as in the present invention include the methods disclosed in U.S. Pat. Nos. 2,912,343, 3,342,605, 2,996,287, 3,429,835 and so on.

Moreover, the above described dicarbocyanine dyes may be homogeneously dispersed into a silver halide emulsion before coating the emulsion on a support, while the dyes can, of course, be dispersed into a silver halide emulsion by any processes for preparing the emulsion.

Each of the silver halide emulsions employed in the present invention can contain a supersensitizer suitable for the dicarbocyanine dye as described hereinbefore in combination with the dicarbocyanine dye. As supersensitizers effective for the dicarbocyanine sensitizing dyes employed in the practice of the present invention, compounds represented by the following general formula (IV) are very useful. The combined use of the dicarbocyanine dyes of the present invention and such a supersensitizer not only brings about a superadditive increase in red sensitivity but also further depresses a lowering of spectral sensitivity occurring with the passage of time under conditions of high humidity.

General formula (IV) is illustrated below:

$$D\text{-}(SO_3M)_n \qquad (IV)$$

wherein M represents a hydrogen atom or a cation which renders the compound water soluble such as an alkali metal salt (e.g., sodium, potassium), an ammonium salt, and the like, *n* represents an integer more than 1 but preferably 14 or less, and D represents a polycyclic aromatic residue as hereinafter defined. The term "polycyclic aromatic residue" means a condensed polycyclic aromatic hydrocarbon residue, a condensed polycyclic aromatic heterocyclic ring residue and a compound residue of the kind which contains two or more aromatic rings but preferably 8 or less aromatic rings (which may be either hydrocarbon rings or heterocyclic rings) directly connected to one another, or attached, through a divalent atom, an aliphatic hydrocarbon chain or other atomic groups, to one another.

Examples of "polycyclic aromatic residues" which can be represented by D in general formula (IV) include a naphthalene residue, a naphthotriazole residue, a diphenyl residue, a terphenyl residue, an N,N'-[1,4-phenylenebis(1,3,5-triazinyl-2-amine)] residue, an N,N'-(1,1'-ethylenebis-1, 4-phenylene)bis-2-pyrimidylamine residue, a 2,2'-(ethylenebis-1, 4-phenylene)-bis-benzotriazole residue and a dibenzothiophene-5,5'-dioxide residue. However, the invention is not intended to be construed as limited to these examples.

Especially useful supersensitizers included in the class of compounds represented by general formula (IV) described above are those which have the following general formula (V):

$$D_1\text{—}A\text{—}D_2 \qquad (V)$$

wherein $D_1$ and $D_2$ each represents a condensed polycyclic aromatic heterocyclic ring residue (e.g., a 2-benzotriazolyl group, 2-naphthotriazolyl group, etc.), or an aromatic heterocyclic ring-substituted amino group (e.g., 1,3,5-triazine-2-ylamino group, 1,3-diamine-2-ylamino group, etc.), which may contain an $—SO_3M$ group and —A— represents a divalent aromatic residue which may contain an $—SO_3M$ group, wherein M has the same meaning as described for general formula (IV). In these compounds at least one of $D_1$, $D_2$ and A must contain as $—SO_3M$ group, e.g., —A— should contain an $—SO_3M$ group when both $D_1$ and $D_2$ do not contain as $—SO_3M$. As —A—, a divalent aromatic residue selected from the group of $—A_1—$ or the group of $—A_2—$ as described below is especially useful.

$-A_1-$

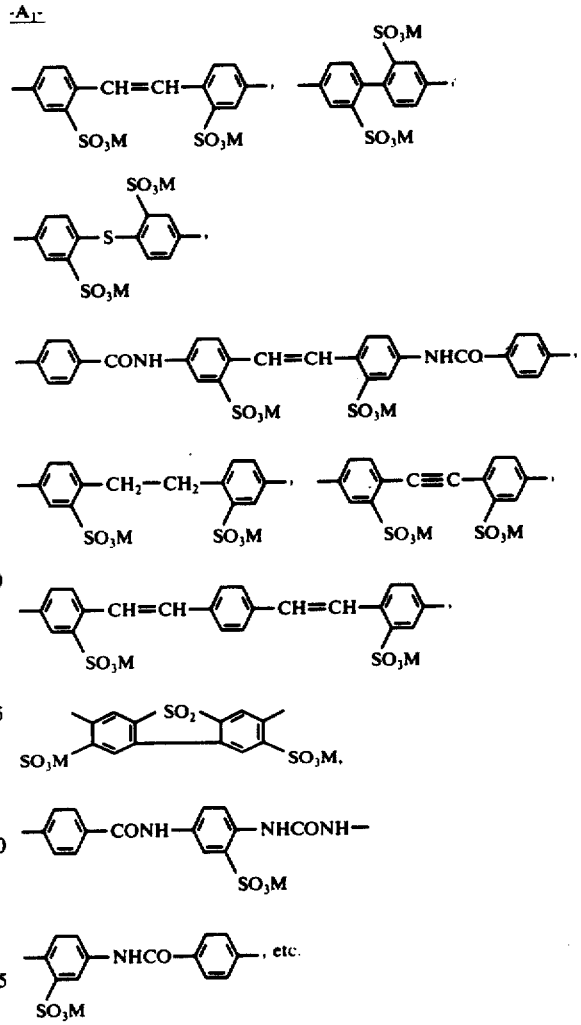

$-A_2-$

-continued

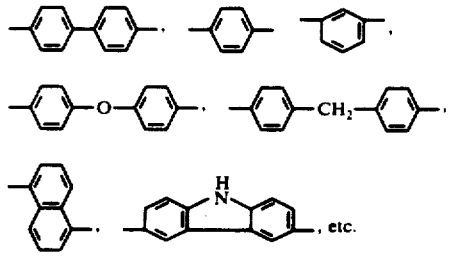

In the above compounds, at least one of $D_1$ and $D_2$ should have an $SO_3M$-containing substituent when a divalent aromatic residue selected from an $—A_2—$ group is employed as —A—, Particularly useful compounds included in the class of compounds represented by general formula (IV) have the following general formula (VI):

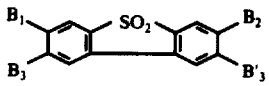

(VI)

wherein $B_1$ and $B_2$ each represents an acylamino group (e.g., an acetoamido, sulfobenzamido, 4-methoxy-3-sulfobenzamido, 2-ethoxybenzamido, 2,4-diethoxybenzamido, a p-toluylamino, 4-methyl-2-methoxybenzamido, 1- naphthoylamino, 2-naphthoylamino,2,4-dimethoxybenzamido, 2-phenylbenzamido or 2-thienylbenzamido group), a sulfo group (which includes sulfonates such as alkali metal salts thereof and the ammonium salt thereof) or a sulfoaryl group (e.g., sulfophenyl, p-sulfodiphenyl, etc.), wherein $B_1$ and $B_2$ may be the same or different from each other, and $B_3$ and $B_3'$ each represents a hydrogen atom or a sulfo group. The compounds represented by general formula (VI) must have at least one sulfo group. Preferred acylamino groups contain from 1 to 20 carbon atoms.

Of the compounds represented by general formula (V), particularly useful compounds have the following general formulae (VII) or (VIII):

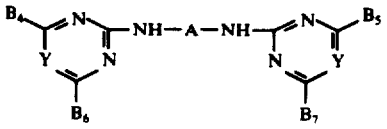

(VII)

wherein —A— has the same meaning as in general formula (V), Y represents =CH-, $=CB_8$- or =N-, wherein $B_8$ represents a lower alkyl group or a halogen atom (e.g., chlorine, bromine, etc.), and $B_4$, $B_5$, $B_6$ and $B_7$ each represents a hydrogen atom, a hydroxy group, an alkoxy group, a lower alkyl group (e.g., methyl, ethyl, etc.), an aryloxy group (e.g., phenoxy, o-tolyloxy, p-sulfophenoxy, etc.), a halogen atom (e.g., chlorine, bromine, etc.), a heterocyclic nucleus (e.g., morpholinyl, piperidyl, etc.), an alkylthio group (e.g., methylthio, ethylthio, etc.), a heterocyclothio group (e.g., benzothiazolylthio, etc.), an arylthio group (e.g., phenylthio, tolylthio etc.), an amino group, an alkylamino group or substituted alkylamino groups (e.g., methylamino, ethylamino, propylamino, dimethylamino, diethylamino, dodecylamino, cyclohexylamino, β-hydroxyethylamino, di-(β-hydroxyethyl)amino, β-sulfoethylamino, etc.), an arylamino group or a substituted arylamino group (e.g., anilino, o-sulfoanilino, m-sulfoanilino, p-sulfoanilino, o-anisylamino, m-anisylamino, p-anisylamino, o-toluidino, m-toluidino, p-toluidino, o-carboxyanilino, m-carboxyanilino, p-carboxyanilino, hydroxyanilino, disulfophenylamino, naphthylamino, sulfonaphthylamino, etc.), a heterocycloamino group (e.g., 2-benzothiazolylamino, 2-pyridylamino, etc.), an aryl group (e.g., phenyl, etc.) or a mercapto group, wherein $B_4$, $B_5$, $B_6$ and $B_7$ may be the same substituent or may differ from one another, and at least one of them must have one or more sulfo groups (which may be of the free acid type or in salt form, e.g., an alkali metal salt such as sodium, potassium, etc.), and

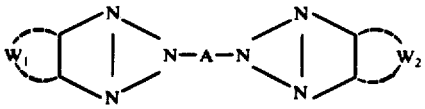

(VIII)

wherein A has the same meaning as in general formula (V) and $W_1$ and $W_2$ each represents the carbon atoms necessary to form a benzene ring or a naphthalene ring, which may be substituted, for example, by a sulfo group.

Each of these supersensitizers can be used in the usually employed "supersensitizing amount". Such an amount can be determined as one skilled in the art thinks proper on the basis of conventional knowledge and experience. Specifically, from several to several tens as much supersensitizer as dye is used in the combination by weight, and in some occasions, several hundreds as much supersensitizer is used as the dye. It is preferred that the ratio of the supersensitizers to the dyes of the invention be on the order of about 2 to 200 times (by weight), more preferably from 5 to 100 times (by weight).

Any silver halide, for example, silver chloride, silver bromide, silver iodide, silver chlorobromide, silver chloroiodide, silver iodobromide, silver chloroiodobromide and the like, may be used in the present invention. In particular, silver chloride, silver chlorobromide, silver chloroiodide and silver chloroiodobromide are preferred to other silver halides described above. In each of silver chloroiodide and silver chloroiodobromide, the iodide content is preferably not more than 1 mol%.

As a suitable vehicle for the silver halide emulsion employed in the present invention, gelatin is usually used, but gelatin derivatives such as acylated gelatin, albumin, agar, gum arabic, alginic acid, hydrophilic resins such as polyvinyl alcohol and polyvinyl pyrrolidone, or cellulose dervatives, which do not adversely affect light-sensitive silver halides, may be used partially or completely instead of gelatin.

Each of these silver halides may be incorporated in an emulsion in the form of either coarse grains or finely divided grains. These silver halide grains can be produced by any conventional procedure such as a single jet method, a double jet method or a controlled double jet method.

Further, the silver halide grains may have a homogeneous crystal structure in all parts of the grain, a layer structure having the feature that the core and the shell of the grain are of a different nature with respect to the crystal structure thereof, or they may be of the so-called conversion type crystal structure as disclosed in British Patent 635,841 and U.S. Pat. No. 3,622,318. In addition, either emulsions of the kind which form a latent image on the surface of the grains to a very appreciable extent, or sensitive silver halide emulsions of the kind which form a latent image inside the grains and substantially no latent image on the surface of the grains may be employed. These photographic emulsions can be produced by the well known ammoniacal method, neutral method or acidic method, as described in C. E. K. Mees & T. H. James, *The Theory of The Photographic Process,* 3rd Ed., Macmillan, New York (1966), and P. Glafkides, *Photographic Chemistry,* Fountain Press, London (1958). The thus obtained photographic emulsions containing silver halide grains are generally washed with water to remove water soluble salts formed as a by-product (for example, potassium nitrate formed as a by-product by the reaction of silver nitrate with potassium bromide) from the emulsion system, and then subjected to heating in the presence of chemical sensitizers, which leads to an elevation in sensitivity without coarsening the grains. On the other hand, such a ripening process may be carried out without removing water soluble salts formed as a by-product. Conventional procedures regarding such post-treatments as described above are described in the aforesaid texts.

A preferred mean diameter of the grains (measured by, e.g., a projected area method or a number average method) is from about 0.04 micron to about 2 microns.

To the silver halide photograhic emulsion employed in the present invention, conventionally used chemical sensitization techniques such as gold sensitization (as disclosed in U.S. Pat. Nos. 2,540,085, 2,597,876, 2,597,915, 2,399,083, etc.), sensitization with a Group VIII metal ion, sulfur sensitization (as disclosed in U.S. Pat. Nos. 1,574,944, 2,278,947, 2,440,206, 2,410,689, 3,189,458, 3,415,649, etc.), reduction sensitization (as disclosed in U.S. Pat. Nos. 2,518,698, 2,419,974, 2,983,610, etc.), or a combination of such sensitization techniques can be used.

More specifically, examples of chemical sensitizers include a sulfur sensitizer such as allylthiocarbamide, thiourea, sodium thiosulfate or cystine; a noble metal sensitizer such as potassium chloroaurate, aurous thiosulfate or potassium chloropaladate; a reduction sensitizer such as tin chloride, phenylhydrazine; and the like.

Also, the emulsion can contain a sensitizer such as a polyoxyethylene derivative, a polyoxypropylene derivative, a quaternary ammonium group-containing derivative or the like.

The silver halide emulsion can contain an appropriate anti-foggant and a proper stabilizer. Specific examples thereof include thiazolium salts as disclosed in U.S. Pat. Nos. 2,131,038 and 2,694,716; azaindenes as disclosed in U.S. Pat. Nos. 2,886,437, 2,444,605 and so on; urazoles as disclosed in U.S. Pat. No. 3,287,135 and so on; sulfocatechols as disclosed in U.S. Pat. No. 3,236,652 and so on; oximes as disclosed in British Patent 623,448 and so on; mercaptotetrazoles as disclosed in U.S. Pat. Nos. 2,403,927, 3,266,897, 3,397,987 and so on; nitron; nitroindazoles; polyvalent metal salts as disclosed in U.S. Pat. No. 2,839,405 and so on; thiuronium salts as disclosed in U.S. Pat. No. 3,220,839 and so on; palladium, platinum and gold salts as disclosed in U.S. Pat. Nos. 2,566,263, 2,597,915 and so on; and the like.

The silver halide photographic emulsion can contain a developing agent such as hydroquinones, catechols, aminophenols, 3-pyrazolidones, ascorbic acid and derivatives thereof, if desired, reductones, phenylenediamines and combinations of these developing agents. The developing agent can be incorporated into a silver halide emulsion layer and/or other photographic layers (e.g., a protective layer, an interlayer, a filter layer, an antihalation layer, a backing layer and so on). The developing agent can be added to the aforesaid layers as a solution prepared by dissolving the agent in an appropriate solvent, or as a dispersion as disclosed in U.S. Pat. No. 2,592,368 and French Patent 1,505,778, if desired.

The silver halides can be dispersed into colloids which can be hardened by various kinds of organic or inorganic hardeners, if desired, such as formaldehyde, chrome alum, 1-hydroxy-3,5-dichlorotriazine sodium salt, glyoxal, dichloroacrolein, etc.

The silver halide photographic emulsion can contain a coating aid such as saponin, alkylarylsulfonates as disclosed in U.S. Pat. No. 2,600,831 and so on, if desired; amphoteric compounds as disclosed in U.S. Pat. No. 3,133,816 and so on; etc.

Further, the silver halide photographic emulsions can contain an antistatic agent, a plasticizer, a fluorescent whitening agent, a development accelerator, an aerial fog inhibitor, a color toning agent and so on.

The silver halide photographic emulsion can also contain a non-diffusible coupler, if desired, in certain cases. Four-equivalent or two-equivalent diketomethylene series yellow couplers, for example, those compounds as disclosed in U.S. Pat. Nos. 3,277,157, 3,415,652, 3,447,928, 3,311,476, 3,408,194 and so on, those compounds as disclosed in U.S. Pat. Nos. 2,875,057, 3,265,506, 3,409,439, 3,551,155, 3,551,156 and so on, and those compounds as disclosed in Japanese Patent Applications (Laid-Open) 26,133/72, 66,836/73 and so on; four-equivalent or two-equivalent pyrazolone series magenta couplers or indazolone series magenta couplers, for example, those compounds as disclosed in U.S. Pat. Nos. 2,600,788, 2,983,608, 3,006,759, 3,062,653, 3,214,437, 3,253,924, 3,419,391, 3,419,808, 3,476,560 and 3,582,322, Japanese Patent Publication 20,636/70, and Japanese Patent Application (Laid-Open) 26,133/72; α-naphthol series cyan couplers and phenol series cyan couplers, for example, those compounds as disclosed in U.S. Pat. Nos. 2,474,293, 2,698,794, 3,034,892, 3,214,437, 3,253,924, 3,311,476, 3,458,315, 3,591,383 and so on, and Japanese Patent Publications 11,304/67 and 32,461/69, and so on, and the like can be employed as the aforesaid non-diffusible couplers.

In addition to such couplers, development inhibitor releasing couplers (DIR couplers), and compounds which release compounds having a development inhibition action can also be incorporated into the photographic emulsions of the present invention. Specific examples of these materials are disclosed in U.S. Pat. Nos. 3,148,062, 3,227,554, 3,253,924, 3,617,291, 3,622,328 and 3,705,201, British Patent 1,201,110, and U.S. Pat. Nos. 3,297,445, 3,379,529 and 3,639,417, and so on.

The above described couplers or the like can be added as a combination of two or more kinds thereof to only one layer, or only one kind of such compound can be added to two or more layers simultaneously, with the intention of satisfying the desired characteristics for the sensitive materials.

The above described couplers include couplers containing water soluble groups such as carboxy, hydroxy, sulfo or like groups, and hydrophobic couplers. They are added to the emulsions by conventional techniques for the addition or the dispersion of couplers. Hydrophobic couplers may be dispersed into the emulsions by various methods, e.g.;

1. by dispersing couplers which have previously been mixed with an organic solvent having a high boiling point (such as phthalic acid esters, trimellitic acid esters, phosphoric acid esters, liquid fatty oils and liquid waxes at ordinary temperatures, etc.) with the aid of an anionic surface active agent, as disclosed in, for example, U.S. Pat. Nos. 2,304,930, 2,322,027, etc.;
2. by dispersing the couplers by mixing them with an organic solvent having a low boiling point or with a water soluble organic solvent, as disclosed in U.S. Pat. Nos. 2,801,170, 2,801,171, 2,949,360, etc.; and
3. by dispersing the couplers alone or together with other couplers, such as colored couplers, DIR couplers or the like, when the couplers themselves have a sufficiently low boiling point (preferably lower than 75° C), as disclosed in, for example, German Patent 1,143,707, etc. Water soluble couplers may be used in the form of an alkaline solution, or may be used together with hydrophobic couplers as a dispersing aid for hydrophobic couplers (e.g., an anionic surface active agent).

On the other hand, a color image can also be formed by developing the emulsion with a diffusible coupler containing color developer.

In addition, the photographic emulsions can optionally contain dyes as are employed for anti-irradiation effects, for example, as disclosed in Japanese Patent Publications 20,389/66, 3,504/68 and 13,168/68, in U.S. Pat. Nos. 2,687,037, 3,423,207 and 2,865,752, in British Patents 1,030,392 and 1,100,546, and so on.

The sensitizing dyes of the present invention can be used in combination with other sensitizing dyes as disclosed in, for example, U.S. Pat. Nos. 3,703,377, 3,397,060, 3,615,635, 3,628,964, British Patent 1,242,588, British Patent 1,293,862, Japanese Patent Publication 4,936/68, Japanese Patent Publication 14,030/69, Japanese Patent 10,773/68, U.S. Pat. No. 3,416,927, Japanese Patent Publication 4,930/68, U.S. Pat. Nos. 3,615,613, 3,615,632, 3,617,295, 3,635,721 and so on.

The sensitizing technique of the present invention is applicable for the production of not only black and white photographic emulsions but also to a wide variety of silver halide emulsions employed as compounds of color sensitive materials. Specific examples of these emulsions include a color positive emulsion, an emulsion for color paper, a color negative emulsion, an emulsion for a reversal color film (wherein a coupler may be present or not), an emulsion employed for a color diffusion transfer process (as disclosed in U.S. Pat. Nos. 3,087,817, 3,185,567, 2,983,606 3,253,915, 3,227,550, 3,227,551, 3,227,552, 3,415,644, 3,415,645, 3,415,646, and so on), an emulsion employed for a dye transfer process (as disclosed in U.S. Pat. No. 2,882,156 and so on), an emulsion employed for a silver dye bleach process (as described in, for example, Friedman, *History of Color Photography*, American Photographic Publishers Co., (1944), particularly chapter 24, and *British Journal of Photography*, Vol. 111, pages 308 - 309, Apr. 7 (1964)).

A multilayer color photographic material useful in the present invention has, for example, a layer structure where a blue-sensitive layer (B), a green-sensitive layer (G) and a red-sensitive layer (R) are coated in sequence where the blue-sensitive layer is first coated on a support, or they may be coated in the order of (R), (G) and (B), or (B), (R) and (G). When coating in the order (R), (G) and (B), a yellow filter layer is preferably coated between (G) and (B). However, the invention is not to be construed as limited to these coating orders.

The silver halide photographic emulsion(s) can be coated on a support, if desired or necessary, together with other photographic layers, and such can be coated by various methods including dip coating, air knife coating, curtain coating and extrusion coating using a hopper as disclosed in U.S. Pat. No. 2,681,294.

Two or more layers can optionally simultaneously be coated according to the methods as disclosed in U.S. Pat. Nos. 2,761,791, 3,508,947, 2,941,898 and 3,526,528, and so on, if desired.

Examples of supports which are chosen depending upon the proposed end use, include planar materials which do not undergo a high dimensional change upon photographic processing such as glass, metal, earthenware and other hard substances, or flexible materials, all of which are conventional. Typical examples of flexible supports include films conventionally used in photographic light-sensitive materials such as a cellulose nitrate film, a cellulose acetate film, a cellulose acetate propionate film, a cellulose acetate butyrate film, a polystyrene film, a polyethylene terephthalate film, a polycarbonate film, and laminates thereof; a thin glass film; paper; and so on. In addition, baryta paper; papers coated or laminated with an α-olefin polymer having 2 to 10 carbon atoms in the monomer units thereof, particularly polyethylene, polypropylene, and an ethylene-butene copolymer or the like; plastic films the surface of which has been matted to increase its adhesion to other macromolecular compounds and to provide excellent printability as disclosed in Japanese Patent Publication 19,068/72 and so on can be effectively used in the present invention.

These supports may be transparent or opaque, depending upon end use. The transparent supports may be either colorless or colored, e.g., by a dye or pigment. Such colored transparent supports are conventionally used in X-ray films, and are known from J. SMPTE, Vol. 67, p. 296 (1958) and the like.

Examples of opaque supports include not only inherently opaque supports such as paper, but also transparent films which are rendered opaque by the addition of a dye or a pigment, such as titanium oxide, plastic films which have received a surface treatment by, e.g., the method disclosed in Japanese Patent Publication 19,068/72, paper and plastic films which completely screen light by the addition of carbon black, dyes or the like, and so on. When the adhesion between a support and a photographic emulsion layer is insufficient, a layer having the property of adhering to both materials may be coated as an underlayer. In addition, the support surface may receive a preliminary treatment such as a corona discharge, ultraviolet irradiation, flame treatment, etc., with the intention of further improving adhesion.

The silver halide photographic materials can be subjected to a dye coupling development using an aromatic primary amine compound such as a p-phenylenediamine derivative, if desired.

Typical examples of such color developers include not only the color developer materials per se but inorganic acid salts thereof such as sulfates, hydrochlorides, nitrates, etc., for example, N,N-diethyl-p-phenylenediamine, 2-amino-5-diethylaminotoluene, 2-amino-5-(N-ethyl-N-laurylamino)toluene, 4-[N-ethyl-N-(β-hydroxyethyl)amino]aniline, 3-methyl-4-amino-N-ethyl-N-(β-hydroxyethyl)aniline, etc., 4-amino-3-methyl-N-ethyl-N-(β-methanesulfoamideethyl)aniline sesquisulfate monohydrate as disclosed in U.S. Pat. No. 2,193,015; N-(2-amino-5-diethylaminophenylethyl)methanesulfoamide sulfate as disclosed in U.S. Pat. No. 2,592,364; N,N-dimethyl-p-phenylenediamine hydrochloride; 3-methyl-4-amino-N-ethyl-N-methoxyethylaniline; and so on.

These color developers are described in detail, for example, in L. F. A. Mason, *Photographic Processing Chemistry*, pp. 226 - 229, Focal Press, London (1966). In addition, it is possible to use these color developers and 3-pyrazolidones in combination.

A wide variety of additives can optionally be added to the color developer used.

Examples of generally used additives to the developer include an alkali (e.g., hydroxides, carbonates and phosphates of alkali metals or ammonium), a pH adjusting or buffering agent (e.g., weak acids such as acetic acid, boric acid, etc., weak bases and salts thereof), a development accelerator (e.g., various pyridinium compounds and cationic compounds as disclosed in U.S. Pat. Nos. 2,648,604, 3,671,247, etc., potassium nitrate and sodium nitrate, polyethylene glycol condensates and derivatives thereof as disclosed in U.S. Pat. Nos. 2,533,990, 2,577,127, 2,950,970, etc., nonionic compounds represented by the polythioethers as disclosed in British Patents 1,020,033 and 1,020,032; polymers having one or more sulfite ester groups as represented by the compounds as disclosed in U.S. Pat. No. 3,068,097; organic amines such as pyridine, ethanolamine, etc., benzyl alcohol, hydrazines and so on), an anti-foggant (e.g., an alkali metal bromide, alkali metal iodide, nitrobenzimidazoles as disclosed in U.S. Pat. Nos. 2,496,940 and 2,656,271; mercaptobenzimidazole, 5-methylbenzotriazole, 1-phenyl-5-mercaptotetrazole, compounds employed for rapid processing solutions as disclosed in U.S. Pat. Nos. 3,112,864, 3,342,596, 3,295,976, 3,615,522, 3,597,199 and so on, thiosulfonyl compounds as disclosed in British Patent 972,211; phenazine-N-oxides as disclosed in Japanese Patent Publication 41,675/71 and other anti-foggants as described in *Kagaku Shashin Binran*, Volume II, pages 29 - 47), stain or sludge inhibitors as disclosed in U.S. Pat. Nos. 3,161,513 and 3,161,514, British Patents 1,030,442, 1,144,481 and 1,251,558, etc., compounds providing inter-image effects as described in U.S. Pat. No. 3,536,487, etc., and preservatives (e.g., sulfites, bisulfites, hydroxylamine hydrochlorides, formaldehyde-bisulfite adducts, alkanolamine-bisulfite adducts, etc.).

The silver halide photographic emulsion is fixed after development processing in a conventional manner, and in some cases subjected to a bleaching treatment. The bleaching treatment and the fixing can be carried out either simultaneously or separately, if desired. Bleach-fixing baths containing both a bleaching agent and a fixing agent (often called a blixing bath) are useful when bleaching and fixing are to be carried out at the same time. A wide variety of compounds can be employed as bleaching agents. Examples of bleaching agents generally used include ferricyanates, bichromates, water soluble salts of cobalt (III), water soluble salts of copper (II), water soluble quinones, nitrophenol, polyvalent metal containing compounds such as iron (III), cobalt (III), copper (II) or like containing compounds, more particularly, complexes prepared from a polyvalent metal cation and an organic acid such as ethylenediamine tetraacetic acid, nitrilotriacetate, iminodiacetate, N-hydroxyethylenediamine triacetate and other aminopolycarbonic acids, malonic acid, tartaric acid, malic acid, diglycolic acid, dithioglycolic acid, or the like, and a copper-2,6-dipicolinic acid complex, peracids such as alkyl peracids, persulfates, permanganates, hydrogen peroxide, etc., hypochlorites, bleaching powder, etc., and so on. Such can be used alone or in a proper combination. Bleach and fixing and bleach-fixing are described in U.S. Pat. No. 3,582,322, etc. Bleach accelerating agents as disclosed in U.S. Pat. Nos. 3,042,520 and 3,241,966, Japanese Patent Publications 8,506/70 and 8,836/70, and so on, and as well as many other conventional additives, can be additionally present in the above described treating solutions.

The sensitizing technique of the present invention can be applied to sensitive materials having an emulsion silver content from several to several hundred times slower than those used in conventional sensitive materials. The present invention is not, of course, limited to such low silver halide content materials, and can be practiced with equal effect with conventional silver halide materials. Such low silver halide materials generally contain as little as about 1/50 to as much as about ½ (by weight) the amount of silver halide in conventional materials. With respect to color sensitive materials having a reduced silver halide content, developed silver formed by dye coupling development is subjected to a halogenation bleach, and then again receives a color development in order to increase the amount of dye formed (as disclosed in U.S. Pat. Nos. 2,623,822 and 2,814,565, etc.). Also a satisfactory color image can be obtained by an image forming method wherein the amount of dye formed is increased using a peroxide or a cobalt complex by taking advantages of intensification processing (as disclosed in German Patent Applications (OLS) 1,598,076, 1,900,540, 1,900,864, 1,917,744, 2,044,833, 2,056,360, 2,226,770, 2,357,694 and 2,357,695, and 2,357,695, in U.S. Pat. Nos. 3,674,490, 3,761,265 and 3,765,890, in Japanese Patent Applications (Laid-Open) 9,728/73, 9,729/73, 84,239/74 and 84,240/74, and so on), or by using chlorous acid or bromous acid by taking advantage of intensification processing (as disclosed in Japanese Patent Applications 128,327/74, 139,917/74 and so on).

Having thus generally described the present invention, the following Examples illustrate currently preferred modes of practicing the invention. In the following Examples all percentages are weight percentages, unless otherwise indicated. The following Examples should not, of course, be construed as limiting the invention thereto.

EXAMPLE 1

To 100 g of a gelatino-silver chlorobromide emulsion (chlorie content: 30 mol%, bromide content: 70 mol%, Ag content: $5.0 \times 10^{-2}$ mol, gelatin content: 7 g, mean grain size: 0.6 micron), a methanol solution of each of the sensitizing dyes of the present invention or sensitizing dyes for comparison was added in a predetermined amount as set forth in Table 1. Each of the resulting emulsions was allowed to stand for one hour with stirring at 40° C, whereafter each of the thus obtained emulsions was applied to a cellulose triacetate film support at a dry thickness of about 5 microns. After drying, each of these film samples was cut into strips. Two of the strips were wedge-wise exposed to a light source covered, respectively, by a blue filter capable of transmitting only light of a wavelength shorter than 500 nm and a yellow filter capable of transmitting only light of a wavelength longer than 500 nm, and then they were developed at 20° C for 10 minutes using a developer having the following composition followed by bleaching, fixing, washing and drying.

Composition of Developer

Monomethylparaaminophenol 1/2 sulfate—0.3 g
Potassium metasulfite—1.4 g
Anhydrous sodium sulfite—38.0 g
Hydroquinone—6.0 g
Sodium carbonate (monohydrate)—22.5 g
Potassium bromide—0.9 g
Citric acid—0.7 g
Water to make—1 l.

The density of the images thus formed was measured using a P-type densitometer (made by Fuji Photo Film Co., Ltd.). The standard point of the optical density to determine the sensitivity was fog + 1.0.

On the other hand, the remaining strip of each sample type was stored for 3 days at 50° C and 80% R.H., followed by exposure, development, fixing, washing, drying and density measurement as above. The results obtained are shown in Table 1.

TABLE 1

| Sample No. | Dye ($2.5 \times 10^{-4}$ mol/l of methanol) and Amount Used (ml/1,000 g emulsion) | | Sensitivity* before Storage Test | Sensitivity* after Storage Test |
|---|---|---|---|---|
| 1 | Dye (a) | 20 | 100 | 95 |
| 2 | Dye (a) | 40 | 110 | 105 |
| 3 | Dye (b) | 20 | 120 | 115 |
| 4 | Dye (b) | 40 | 130 | 130 |
| 5 | Dye (d) | 20 | 105 | 105 |
| 6 | Dye (d) | 40 | 115 | 115 |
| 7 | Dye (l) | 20 | 100 | 95 |
| 8 | Dye (l) | 40 | 110 | 105 |
| 9 | Dye (m) | 20 | 105 | 100 |
| 10 | Dye (m) | 40 | 120 | 115 |
| 11 | Dye-F (for comparison) | 20 | 60 | 45 |

TABLE 1-continued

| Sample No. | Dye ($2.5 \times 10^{-4}$ mol/l of methanol) and Amount Used (ml/1,000 g emulsion) | | Sensitivity* before Storage Test | Sensitivity* after Storage Test |
|---|---|---|---|---|
| 12 | Dye F for (comparison) | 40 | 70 | 60 |
| 13 | Dye-G (for comparison) | 20 | 75 | 65 |
| 14 | Dye-G (for comparison) | 40 | 90 | 80 |
| 15 | Dye-H (for comparison) | 20 | 55 | 40 |
| 16 | Dye-H (for comparison) | 40 | 60 | 50 |
| 17 | Dye-I (for comparison) | 20 | 70 | 60 |
| 18 | Dye-I (for comparison) | 40 | 85 | 75 |

*Sensitivity is shown as a relative value determined on the basis of the sensitivity measured before the storage test with respect to the sensitive material of sample number 1.

It will be clearly understood from the values of Table 1 that the sensitizing dyes of the present invention have higher red sensitivity, and that the lowering of spectral sensitivity upon storage at high humidity is remarkably small as compared with the comparison dyes.

Dyes (a), (b), (d), (l) and (m) are the dyes of the present invention described above, while Dye-F, Dye-G, Dye-H and Dye-I are comparison dyes which have the following formulae, respectively:

Dye-F (disclosed in Japanese Patent Publication 550/71)

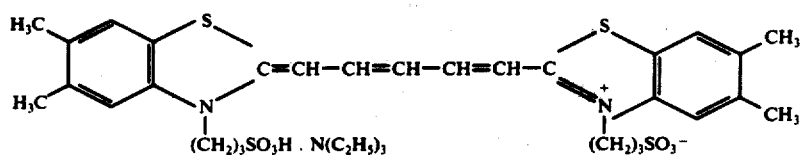

Dye-G (disclosed in Japanese Patent Publication 550/71)

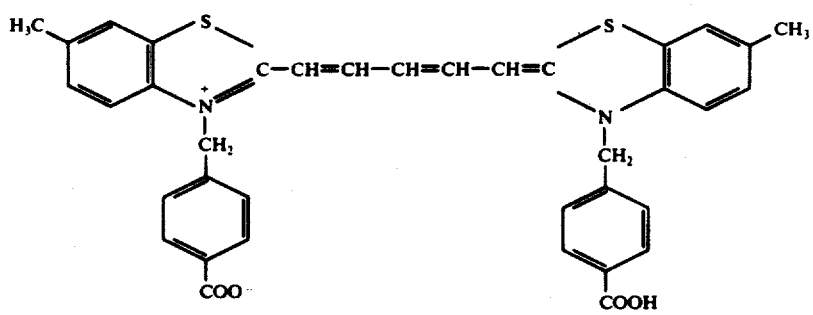

Dye-H (disclosed in Japanese Patent Publication 22,189/70)

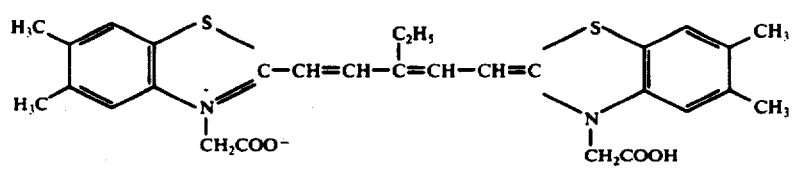

Dye-I (disclosed in Japanese Patent Publication 22,189/70)

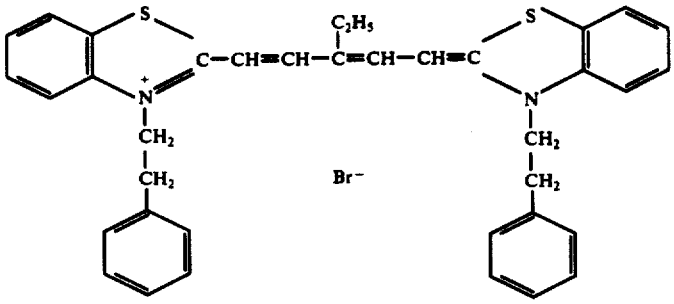

EXAMPLE 2

A silver chlorobromide photographic emulsion (bromide content: 90 mol%, chloride content: 10 mol%) containing as a yellow dye image forming coupler α-(4-palmitamidephenoxy)-α-pyvaloyl-4-sulfoamylacetoanilide (disclosed in U.S. Pat No. 3,408,194) was coated on photographic paper which had been covered with polyethylene film to produce a blue-sensitive emulsion layer. This blue-sensitive emulsion layer contained 2-n-octadecyl-5-(2-sulfo-tert-butyl)hydroquinone potassium salt as a stain inhibitor). A gelatin interlayer containing dioctylhydroquinone was coated on the blue-sensitive emulsion layer. A green-sensitive emulsion layer was prepared by coating a green-sensitive silver chlorobromide photographic emulsion (bromide content: 70 mol% and chloride content: 30 mol%) containing as a magenta dye image forming coupler 1-phenyl-3-methyl-4-(4-methylsulfonylphenoxy)-5-pyrazolone on the gelatin interlayer. The coupler was used as a dispersion prepared by dispersing it into tricresyl phosphate (a conventional coupler solvent). The green-sensitive emulsion layer contained dioctylhydroquinone as a stain inhibitor and green-sensitive sensitizing dyes. A gelatin layer containing dioctylhydroquinone dispersed in tricresyl phosphate (solvent) was coated on the green-sensitive emulsion layer. Each of the sensitizing dyes of the present invention and red-sensitive sensitizing dyes employed for comparison was added to the respective silver chlorobromide emulsion portion (bromide content: 70 mol% and chloride content: 30 mol%) in a predetermined amount as set forth in Table 2, and, additionally, a supersensitizing dye was added thereto. To the thus obtained red-sensitive emulsions, 1-hydroxy-4-maleimide-2-naphthamide was added as a cyan dye image forming coupler. Each of these red-sensitive emulsions was spread over the gelatin layer in layer form. The couplers were previously dispersed into dibutyl phthalate. As the supersensitizing dye, 4,4'-bis(4,6-dianilino-s-triazine-2-ylamino)stilbene-2,2'-disulfonic acid disodium salt was added in the amount of 2.0 g per 1 kg of emulsion. The red-sensitive emulsion layer contained dioctyl hydroquinone as a stain inhibitor.

The above described multilayer coated samples were wedge-wise exposed to a light source covered by a red filter, and subjected to color development at the conditions described below using the treating solutions having the compositions set forth below.

Color Development Processing

| Process | Temperature | Time |
|---|---|---|
| | (° C) | (minute) |
| Color development | 30 | 6 |
| Stopping | " | 2 |
| Washing | " | 2 |
| Bleaching-fixing | " | 1.5 |
| Washing | " | 2 |
| Stabilizing | " | 2 |
| Drying | | |

The processing solutions used had the following compositions.

| | | |
|---|---|---|
| Color Developer | | |
| Benzyl alcohol | 12.0 | ml |
| Diethylene glycol | 3.5 | ml |
| Sodium hydroxide | 2.0 | g |
| Sodium sulfite | 2.0 | g |
| Potassium bromide | 0.4 | g |
| Sodium chloride | 1.0 | g |
| Borax | 4.0 | g |
| Disodium ethylenediamine tetraacetate (dihydrate) | 2.0 | g |
| 4-Amino-3-methyl-N-ethyl-N-(β-methanesulfonamidoethyl)aniline sesquisulfate monohydrate | 5.0 | g |
| Hydroxylamine sulfate | 2.0 | g |
| Water to make | 1 | l |
| Stopping Solution | | |
| Sodium thiosulfate | 10 | g |
| Ammonium thiosulfate (70 wt%) | 30 | ml |
| Sodium acetate | 5 | g |
| Acetic acid | 30 | ml |
| Potassium alum | 15 | g |
| Water to make | 1 | l |
| Bleaching-Fixing Solution | | |
| Ferric sulfate | 20 | g |
| Disodium ethylenediamine tetraacetate (dihydrate) | 36 | g |
| Sodium carbonate (monohydrate) | 17 | g |
| Sodium sulfite | 5 | g |
| 70% Aqueous solution of ammonium thiosulfate | 100 | ml |
| Boric acid | 5 | g |
| After adjusted to pH 6.0 | | |
| Water to make | 1 | l |
| Stabilizing Solution | | |
| Boric acid | 5 | g |
| Sodium citrate | 5 | g |
| Sodium metaborate (tetrahydrate) | 3 | g |
| Potassium alum | 15 | g |
| Water to make | 1 | l |

The density of the images formed was measured using a P-type densitometer (made by Fuji Photo Film Co., Ltd.). The standard point of the optical density to determine the sensitivity was fog + 1.0. The results obtained are shown in Table 2.

TABLE 2

| Sample No. | Dye (5 × $10^{-4}$ mol/l of methanol) and Amount Used (ml/1,000 g of emulsion) | | Relative Sensitivity | Fog |
|---|---|---|---|---|
| 1 | Dye (a) | 50 | 100 | 0.08 |
| 2 | Dye (a) | 100 | 130 | 0.08 |
| 3 | Dye-A (for comparison) | 50 | 75 | 0.09 |
| 4 | " | 100 | 85 | 0.10 |
| 5 | Dye (c) | 50 | 100 | 0.08 |
| 6 | " | 100 | 125 | 0.08 |
| 7 | Dye-B (for comparison) | 50 | 70 | 0.08 |
| 8 | " | 100 | 80 | 0.08 |
| 9 | Dye (e) | 50 | 100 | 0.08 |
| 10 | " | 100 | 125 | 0.08 |
| 11 | Dye-C (for comparison) | 50 | 65 | 0.08 |
| 12 | " | 100 | 75 | 0.09 |

The comparison dyes had the following formulae, where "Me" is methyl and "Et" is ethyl:

Dye-A

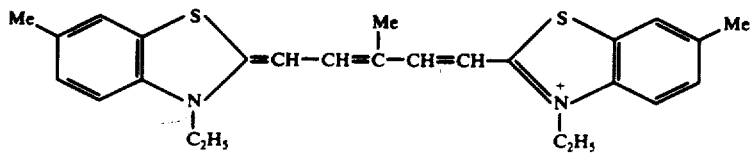

Dye-B

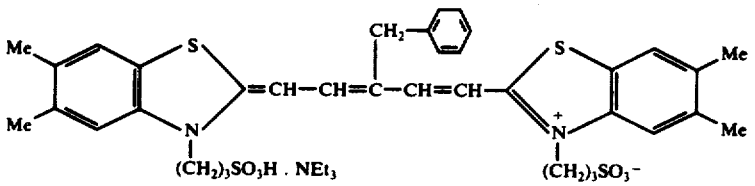

Dye-C

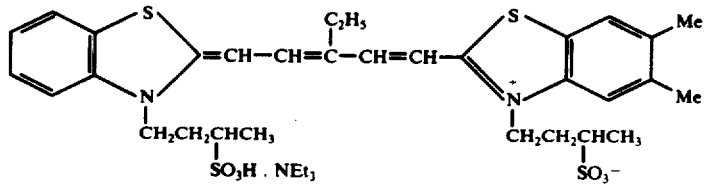

It is apparent from the results in Table 2 that the sensitizing dyes of the present invention have high sensitivity.

EXAMPLE 3

Methanol solutions of sensitizing dyes of the present invention were added to silver iodobromide emulsion portions in predetermined amounts as set forth in Table 3. Next, 2-[α-(2,5-di-tert-amylphenoxy)butyramide]-4,6-dichloro-5-methylphenol (a cyan coupler) was dissolved in dibutyl phthalate and ethyl acetate in a conventional manner, and the solution dispersed into a gelatin solution using sodium alkylbenzene sulfonate to form an emulsion dispersion. The emulsion dispersion was then added to each of the emulsion portions. Each of the resulting emulsion portions was coated on a cellulose triacetate film support, whereafter a gelatin interlayer was coated thereon. Further, a conventional green-sensitive silver iodobromide emulsion to which an emulsion dispersion of 1-(2,4-dimethyl-6-chlorophenyl)-3-{3-[α-(m-pentadecylphenoxy)butyramide]-benzamide}-5-pyrazolone (prepared as with the above cyan coupler) was added as a magenta coupler was coated on the gelatin interlayer. A yellow filter layer containing colloidal silver was then coated on the green-sensitive emulsion layer. A silver iodobromide emulsion sensitized by a conventional gold and a sulfur sensitization to which an emulsion dispersion of α-pivalyl-α-[4-(4-benzyloxyphenylsulfonyl)phenoxy]-2-chloro-5-[γ-(2,4-di-tert-amylphenoxy)butyramide]-acetanilide, prepared as with the above cyan coupler, was added as a yellow coupler was additionally coated on the filter layer. Multilayer color sensitive material samples were thus obtained which were cut into two samples. The thus obtained samples were each exposed in the same manner as in Example 2, and then developed at 22° C for 10 minutes using a color developer having the same composition as in Example 2, followed by bleaching and fixing in a conventional manner. Sensitometry measurements were performed on each of these processed fresh samples. On the other hand, the remaining sample of each sample was stored for four months at a room temperature, followed by exposure, development, bleaching, fixing and sensitometry measurements as for the fresh samples. The results obtained are shown in Table 3.

TABLE 3

| Sample No. | Dye (5 × $10^{-4}$ mol/l of methanol) and Amount Used (ml/1,000 g of emulsion) | | Relative Sensitivity | Relative Sensitivity after 4 Months |
|---|---|---|---|---|
| 1 | Dye (b) | 20 | 100 | 100 |
| 2 | Dye (b) | 40 | 135 | 135 |
| 3 | Dye (c) | 20 | 100 | 99 |
| 4 | Dye (c) | 40 | 130 | 127 |
| 5 | Dye (g) | 20 | 95 | 92 |
| 6 | Dye (g) | 40 | 125 | 122 |
| 7 | Dye (j) | 20 | 95 | 90 |
| 8 | Dye (j) | 40 | 120 | 115 |
| 9 | Dye-B (for comparison) | 20 | 90 | 81 |
| 10 | Dye-B (for comparison) | 40 | 110 | 98 |

EXAMPLE 4

Samples produced in the same manner as in Example 2 were kept for 2 days at 50° C and 80% relative humidity, and then exposed to a light source covered by a red filter, followed by color development as in Example 1. Red sensitivity (in accordance with density measurement using a red filter) and the degree of diffusion sensitization (in accordance with density measurement using a blue filter) were determined for each of these samples. The results obtained are shown in Table 4.

TABLE 4

| Sample No. | Dye ($5 \times 10^{-4}$ mol/l of methanol) and Amount Used (ml/1000 g of emulsion) | | Sample Kept at 20° C and 60% RH Covered by Red Filter | Sample Kept at 20° C and 60% RH Covered by Blue Filter | Sample Kept at 50° C and 80% RH Covered by Red Filter | Sample Kept at 50° C and 80% RH Covered by Blue Filter |
|---|---|---|---|---|---|---|
| 1 | Dye (b) | 50 | 100 (standard) | — | 95 | — |
| 2 | Dye (b) | 100 | 135 | — | 135 | — |
| 3 | Dye-D (for comparison) | 50 | 75 | — | 45 | 10 |
| 4 | Dye-D (for comparison) | 100 | 80 | — | 50 | 25 |
| 5 | Dye (c) | 50 | 100 (standard) | — | 90 | — |
| 6 | Dye (c) | 100 | 125 | — | 120 | — |
| 7 | Dye-B (for comparison) | 50 | 70 | — | 43 | 15 |
| 8 | Dye-B (for comparison) | 100 | 80 | — | 55 | 25 |
| 9 | Dye (e) | 50 | 100 (standard) | — | 95 | — |
| 10 | Dye (e) | 100 | 125 | — | 125 | — |
| 11 | Dye-C (for comparison) | 50 | 65 | — | 40 | 10 |
| 12 | Dye-C (for comparison) | 100 | 75 | — | 45 | 20 |
| 13 | Dye (m) | 50 | 100 (standard) | — | 90 | — |
| 14 | Dye (m) | 100 | 130 | — | 125 | — |
| 15 | Dye-E (for comparison) | 50 | 85 | — | 58 | 25 |
| 16 | Dye-E (for comparison) | 100 | 110 | — | 65 | 35 |

The dyes used for comparison herein had the following formulae, where "Me" is methyl and "Et" is ethyl; Dye-C had the formula given in Example 2.

Dye-D

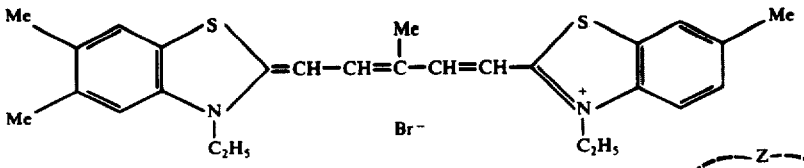

Dye-E

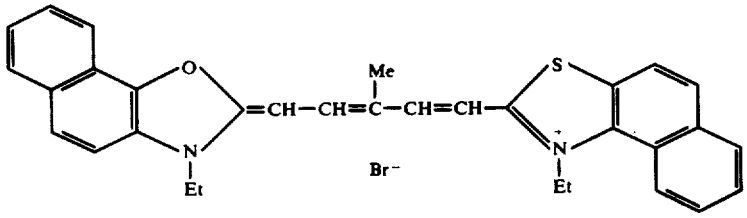

As is apparent from the results shown in Table 4, the sensitizing dyes of the present invention provide a low reduction in sensitivity and a low diffusion sensitization upon storing the sensitive materials containing them under the conditions of high temperature and high humidity.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising a support having coated thereon at least one photographic emulsion layer containing a dicarbocyanine dye represented by general formula (I):

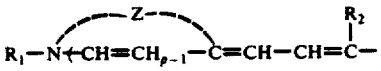

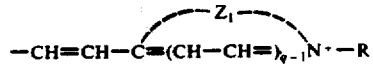

$(X^-)_{n-1}$ (I)

wherein R represents a sulfo group-containing alkyl group or a carboxy group-containing alkyl group, $R_1$ represents an aralkyl group or an aryloxyalkyl group, $R_2$ represents a hydrogen atom, a halogen atom, an alkyl group or an aralkyl group, *p* and *q* represent 1 or 2, *n* represents 1 or 2 and when *n* equals 1 the dye forms an intermolecular salt, X represents an anion and Z and $Z_1$ each represent the non-metallic atoms necessary to complete a thiazole nucleus, selenazole nucleus, oxazole nucleus, quinoline nucleus, 3,3-dialkylindolenine nucleus, imidazole nucleus or pyridine nucleus.

2. A silver halide photographic light-sensitive material defined by claim 1, wherein said photographic emulsion layer additionally contains a compound represented by the following general formula (IV):

$$D\text{-}(SO_3M)_n \qquad \text{(IV)}$$

wherein M represents a hydrogen atom or a cation which renders the compound water soluble, *n* represents an integer greater than 1 and D represents a polycyclic aromatic residue.

3. A silver halide photographic light-sensitive material defined by claim 1, wherein said emulsion layer is a red-sensitive emulsion layer which is present with other light-sensitive emulsion layers, all of which contain at least one coupler.

4. A silver halide color photographic light-sensitive material defined by claim 1, wherein at least three light-sensitive emulsion layers are present: a red-sensitive emulsion layer, a green-sensitive emulsion layer and a blue-sensitive emulsion layer.

5. A silver halide color photographic light-sensitive material defined by claim 4, wherein each of said red-sensitive emulsion layer, said green-sensitive emulsion layer and said blue-sensitive emulsion layer contains at least one color coupler.

6. A silver halide color photographic light-sensitive material as defined by claim 1, wherein Z and $Z_1$ each represents the non-metallic atoms necessary to complete a benzothiazole nucleus, a naphthothiazole nucleus or a naphthoxazole nucleus, and $R_2$ represents an alkyl group or an aralkyl group.

7. A silver halide color photographic light-sensitive material defined in claim 1, wherein $R_1$ in general formula (I) is a phenethyl group, a phenylpropyl group or a phenylbutyl group.

8. A silver halide color photographic light-sensitive material defined by claim 7 containing at least one dicarbocyanine dye selected from the group consisting of:

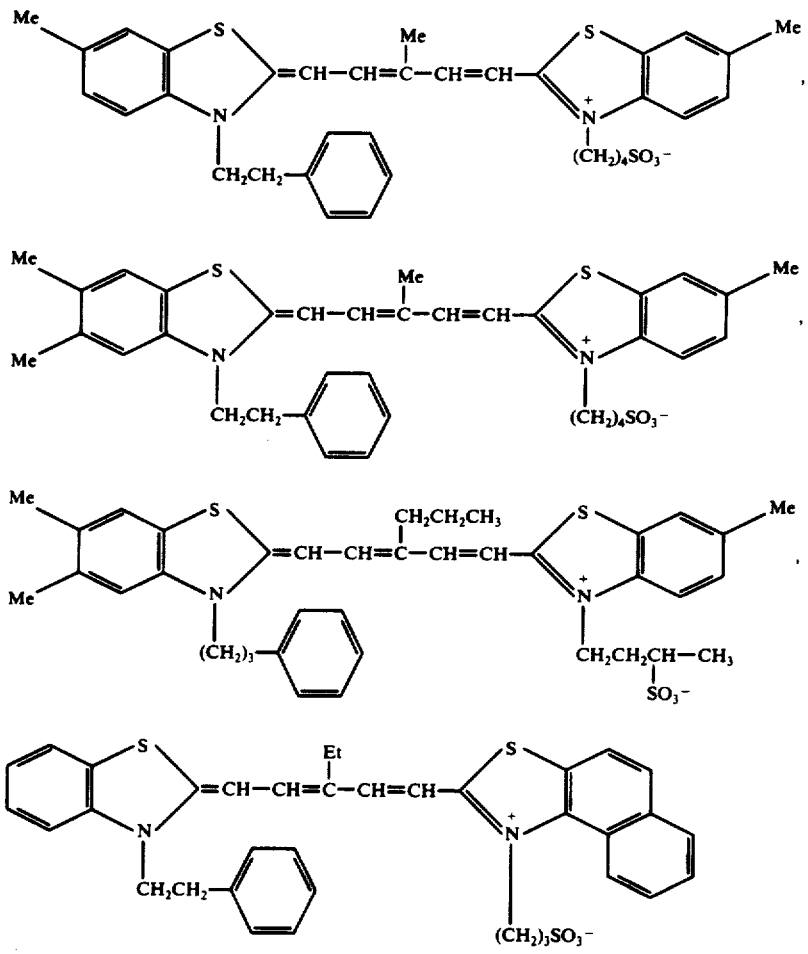

and

-continued

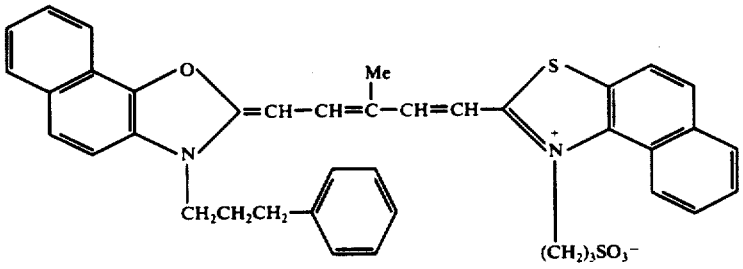

wherein Me is methyl and Et is ethyl.

9. A silver halide color photographic light-sensitive material defined by claim 1, wherein $R_1$ in general formula (I) is a phenoxyethyl group, a phenoxypropyl group or a phenoxybutyl group.

10. A silver halide color photographic light-sensitive material defined by claim 9, wherein said dicarbocyanine dye represented by general formula (I) is at least one dye selected from the group consisting of:

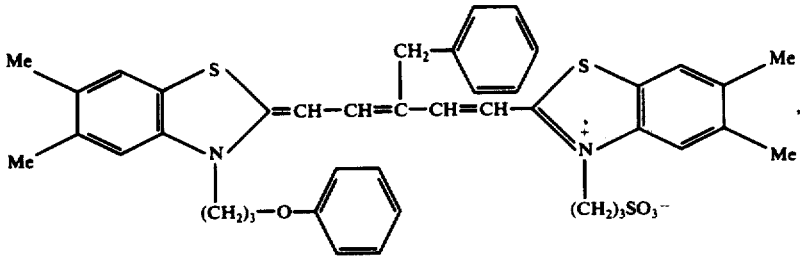

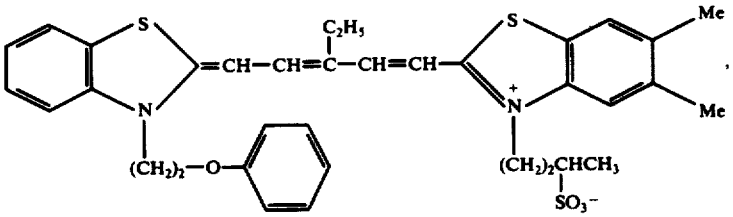

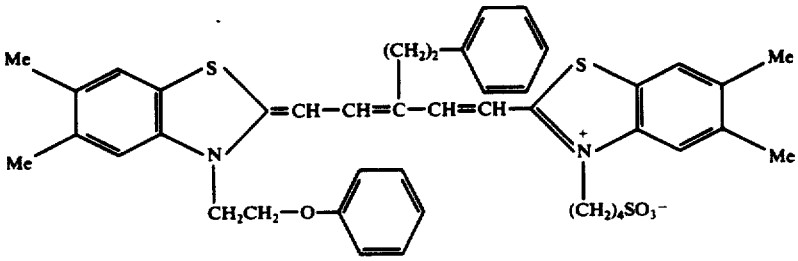

and

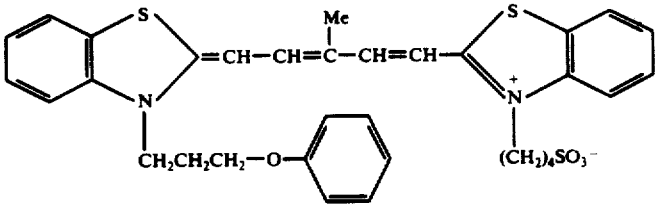

wherein Me is methyl and Et is ethyl.

11. A silver halide color photographic light-sensitive material defined by claim 1, wherein said photographic emulsion layer contains silver chloride grains, silver chloroiodide grains or silver chloroiodobromide grains.

12. A silver halide color photographic light-sensitive material defined by claim 11, wherein said photographic emulsion layer contains silver chloride grains.

13. A silver halide color photographic light-sensitive material defined by claim 11, wherein said photographic emulsion layer contains silver chloroiodide grains.

14. A silver halide color photographic light-sensitive material defined by claim 11, wherein said photographic emulsion layer contains silver chloroiodobromide grains.

15. A silver halide color photographic light-sensitive material defined by claim 13, wherein said silver chloroiodide grains have an iodide content of not more than 1%.

16. A silver halide color photographic light-sensitive material defined by claim 14, wherein said silver chloroiodobromide grains have an iodide content of not more than 1%.

17. A silver halide photographic light-sensitive material defined by claim 1, wherein $R_2$ is hydrogen.

18. A silver halide photographic light-sensitive material defined by claim 1, wherein $R_2$ is an alkyl group.

19. A silver halide photographic light-sensitive material defined by claim 1, wherein Z and $Z_1$ each represents the non-metallic atoms necessary to complete a thiazole nucleus.

20. A silver halide photographic light-sensitive material defined by claim 1, wherein Z and $Z_1$ each represents the non-metallic atoms necessary to complete a selenazole nucleus.

21. A silver halide photographic light-sensitive material defined by claim 1, wherein Z represents the non-metallic atoms necessary to complete an oxazole nucleus and $Z_1$ represents the non-metallic atoms necessary to complete a thiazole nucleus.

22. A method of preventing diffusion sensitization and spectral sensitivity from lowering with the passage of time which comprises incorporating into at least one photographic emulsion layer of a silver halide photographic light-sensitive material a dicarbocyanine dye represented by general formula (I):

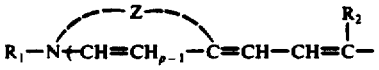

-continued

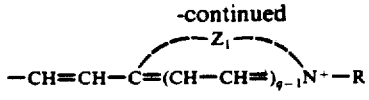

$(X^-)_{n-1}$ (I)

wherein R represents a sulfo group-containing alkyl group or a carboxy-containing alkyl group, $R_1$ represents an aralkyl group or an aryloxyalkyl group, $R_2$ represents a hydrogen atom, a halogen atom, an alkyl group or an aralkyl group, *p* and *q* represent 1 or 2, *n* represents 1 or 2 and when *n* equals 1 the dye forms an intermolecular salt, X represents an anion and Z and $Z_1$ each represents the non-metallic atoms necessary to complete a thiazole nucleus, selenazole nucleus, oxazole nucleus, quinoline nucleus, 3,3-dialkylindolenine nucleus, imidazole nucleus or pyridine nucleus.

23. The method of claim 22, where there is additionally incorporated into said emulsion layer a compound represented by the following general formula (IV):

$$D(SO_3M)_n \quad \text{(IV)}$$

wherein M represents a hydrogen atom or a cation which renders the compound water soluble, *n* represents an integer 1 or above and D represents a polycyclic aromatic residue.

24. The method of claim 22, wherein $R_2$ is a hydrogen group.

25. The method of claim 22, wherein $R_2$ is an alkyl group.

26. The method of claim 22, wherein Z and $Z_1$ each represents the non-metallic atoms necessary to complete a thiazole nucleus.

27. The method of claim 22, wherein Z and $Z_1$ each represents the non-metallic atoms necessary to complete a selenazole nucleus.

28. The method of claim 22, wherein Z represents the non-metallic atoms necessary to complete an oxazole nucleus and $Z_1$ represents the non-metallic atoms necessary to complete a thiazole nucleus.

* * * * *